US006409298B1

(12) United States Patent
Ahne et al.

(10) Patent No.: US 6,409,298 B1
(45) Date of Patent: Jun. 25, 2002

(54) SYSTEM AND METHOD FOR CONTROLLING CURRENT DENSITY IN THERMAL PRINTHEADS

(75) Inventors: Adam Jude Ahne; Mark Joseph Edwards; John Thomas Writt, all of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/583,687

(22) Filed: May 31, 2000

(51) Int. Cl.[7] ..... B41J 29/38; B41J 29/393
(52) U.S. Cl. ..... 347/14; 347/19
(58) Field of Search ..... 347/14, 60, 61, 347/62, 195, 205, 206, 209

(56) References Cited

U.S. PATENT DOCUMENTS

| | | | | | |
|---|---|---|---|---|---|
| 4,532,530 | A | | 7/1985 | Hawkins | 347/62 |
| 4,712,172 | A | | 12/1987 | Kiyohara et al. | 347/60 |
| 4,746,937 | A | | 5/1988 | Realis Luc et al. | 347/11 |
| 4,935,752 | A | | 6/1990 | Hawkins | 347/162 |
| 4,947,189 | A | | 8/1990 | Braun et al. | 347/62 |
| 5,083,137 | A | | 1/1992 | Badyal et al. | 347/14 |
| 5,359,352 | A | | 10/1994 | Saita et al. | 347/62 |
| 5,418,558 | A | | 5/1995 | Hock et al. | 347/14 |
| 5,519,417 | A | | 5/1996 | Stephany et al. | 347/14 |
| 5,559,535 | A | | 9/1996 | Otsuka et al. | 347/14 |
| 5,576,745 | A | | 11/1996 | Matsurbara | 347/14 |
| 5,610,635 | A | * | 3/1997 | Murray et al. | 347/7 |
| 5,710,070 | A | | 1/1998 | Chan | 438/21 |
| 5,710,689 | A | | 1/1998 | Becerra et al. | 361/57 |
| 5,736,995 | A | | 4/1998 | Bohorquez et al. | 347/14 |
| 5,736,997 | A | | 4/1998 | Bolash et al. | 347/19 |
| 5,742,307 | A | * | 4/1998 | Watrobski et al. | 347/62 |
| 5,838,340 | A | | 11/1998 | Shimoda | 347/14 |
| 5,838,356 | A | | 11/1998 | Gunther et al. | 347/194 |
| 5,844,581 | A | | 12/1998 | DeJoseph et al. | 347/14 |
| 6,123,419 | A | * | 9/2000 | Cleland | 347/62 |

FOREIGN PATENT DOCUMENTS

| | | | | | |
|---|---|---|---|---|---|
| JP | 5-169661 | A | * | 7/1993 | 347/14 |

* cited by examiner

*Primary Examiner*—John Barlow
*Assistant Examiner*—Alfred E. Dudding
(74) *Attorney, Agent, or Firm*—Mike Nieberding; Jacqueline M. Daspit

(57) ABSTRACT

Electromigration within heater resistors of printheads is prevented by taking into account a resistance degradation characteristic of the heater resistors. In one method a burn in operation of the printhead heater resistors is provided in order to bring the heater resistor resistance to a substantially stable resistance value. Alternatively, a method of controlling firing of a heater resistor within a printhead of an ink jet printer involves establishing a desired current density or maximum acceptable current density for the heater resistor. A resistance of the heater resistor is thereafter monitored during printing operations. Based at least in part upon the monitored resistance, a firing voltage across the heater resistor is adjusted in order to maintain the desired current density through the heater resistor or in order to hold current density through the heater resistor at or below the maximum acceptable current density.

29 Claims, 8 Drawing Sheets

SYSTEM AND METHOD FOR CONTROLLING CURRENT DENSITY IN THERMAL PRINTHEADS

TECHNICAL FIELD

The present invention relates generally to printing devices which include printheads of the type having firing or heater resistors for effecting the ejection of ink droplets and, more particularly, to a system and method for controlling current density in the heater resistors of such printheads.

BACKGROUND OF THE INVENTION

Thermal ink jet printer mechanisms which utilize printheads having heater resistors for effecting the ejection of small ink droplets from the printhead are well known. The ejection of a large number of small ink droplets at controlled locations on a printing medium produces a desired printed image.

One problem associated with printheads used in ink jet printer mechanisms is early life failures resulting from electromigration within the heater resistors of the printheads. For example, the resistance of heater resistors made with Tantalum-Aluminum thick film decreases over time as the heater resistors are fired. This change in resistance causes the operating current to increase for fixed voltage drive systems. If the operating current is not controlled, excess current can lead to current density induced electromigration of Al ions to create higher concentration Al ion areas which are lower in resistance and allow even more current. A spiraling resistance decrease can occur that quickly leads to heater resistors burning out in early usage.

Accordingly, it would be advantageous to provide a system and method for controlling the current density through heater resistors of ink jet printheads in order to reduce or prevent the detrimental effects of electromigration.

SUMMARY OF THE INVENTION

In one aspect of the invention, a method for limiting electromigration within heater resistors of a printhead of an ink jet printer involves determining a resistance drop off characteristic of the printhead heater resistors and identifying a substantially stable resistance value of the printhead heater resistors based upon the resistance drop off characteristic. The printhead is then run through a resistor bum in operation which involves repeatedly firing a multiplicity of the heater resistors until a resistance value of each heater resistor of the multiplicity drops to the substantially stable resistance value. This technique takes advantage of the fact that the resistance drop off characteristic of the heater resistors tends to stabilize after a certain number of firings. The burn in operation may be performed during the manufacturing stage of a printer mechanism, or may be performed during a printer initialization sequence after delivery of the printer mechanism to a consumer. Further, the burn in operation may be performed in a dry mode where no ink is delivered to the printhead for ejection, but may also be performed in an ink ejection mode.

In another aspect of the present invention, a method of controlling firing of a heater resistor within a printhead of an ink jet printer involves establishing a desired current density or maximum acceptable current density for the heater resistor. A resistance of the heater resistor is thereafter monitored during printing operations. Based at least in part upon the monitored resistance, a firing voltage across the heater resistor is adjusted in order to maintain the desired current density through the heater resistor or in order to hold current density through the heater resistor at or below the maximum acceptable current density. Thus, the method accounts for changes in resistance of the heater resistor over the course of operation of the printer. Various techniques can be used to track the resistance of the heater resistor.

A further aspect of the present invention provides a printer mechanism including a printhead having a plurality of heater resistors. A printhead driver circuit is operatively connected to the printhead for selectively energizing the heater resistors. A controller is connected with the printhead driver circuit for effecting operation of the driver circuit. The controller is operable to determine a resistance of the printhead heater resistors and to adjust a firing voltage across the heater resistors based at least in part upon the determined resistance value. The printer can therefore be utilized to maintain a desired current density through the heater resistors or to hold current density through the heater resistors at or below a maximum acceptable current density.

DETAILED DESCRIPTION

Figure 1:
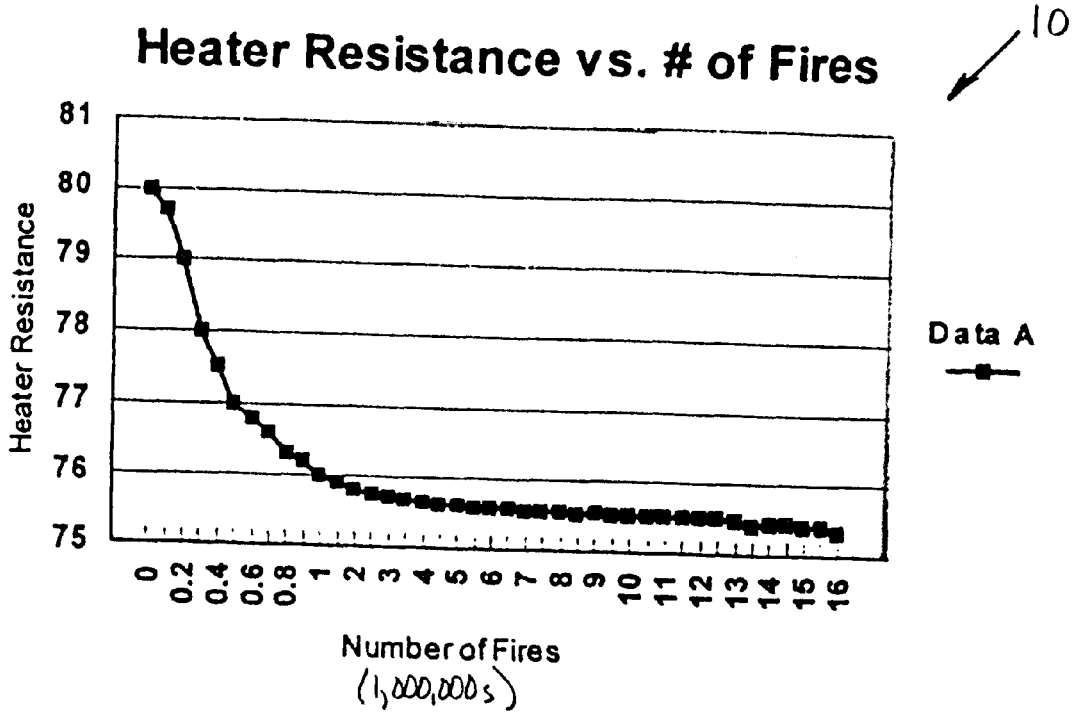
FIG. 1 is a graph showing a typical heater resistor resistance degradation curve.

Referring now to FIG. 1, an exemplary resistance degradation curve 10 for a heater resistor of an ink jet printhead is provided. As shown, the resistance of the heater resistor tends to decrease significantly over approximately the first 500,000 to 800,000 firings of the heater resistor until coming to a substantially stable resistance value. If a fixed voltage is applied to the heater resistor over the period that the resistance decreases, the current through the heater resistor and thus the current density in the heater resistor will tend to increase. In some cases the current density can reach unacceptable levels which cause the aforementioned electromigration within the heater resistor and subsequent early heater resistor burnout or failure.

Figure 2:
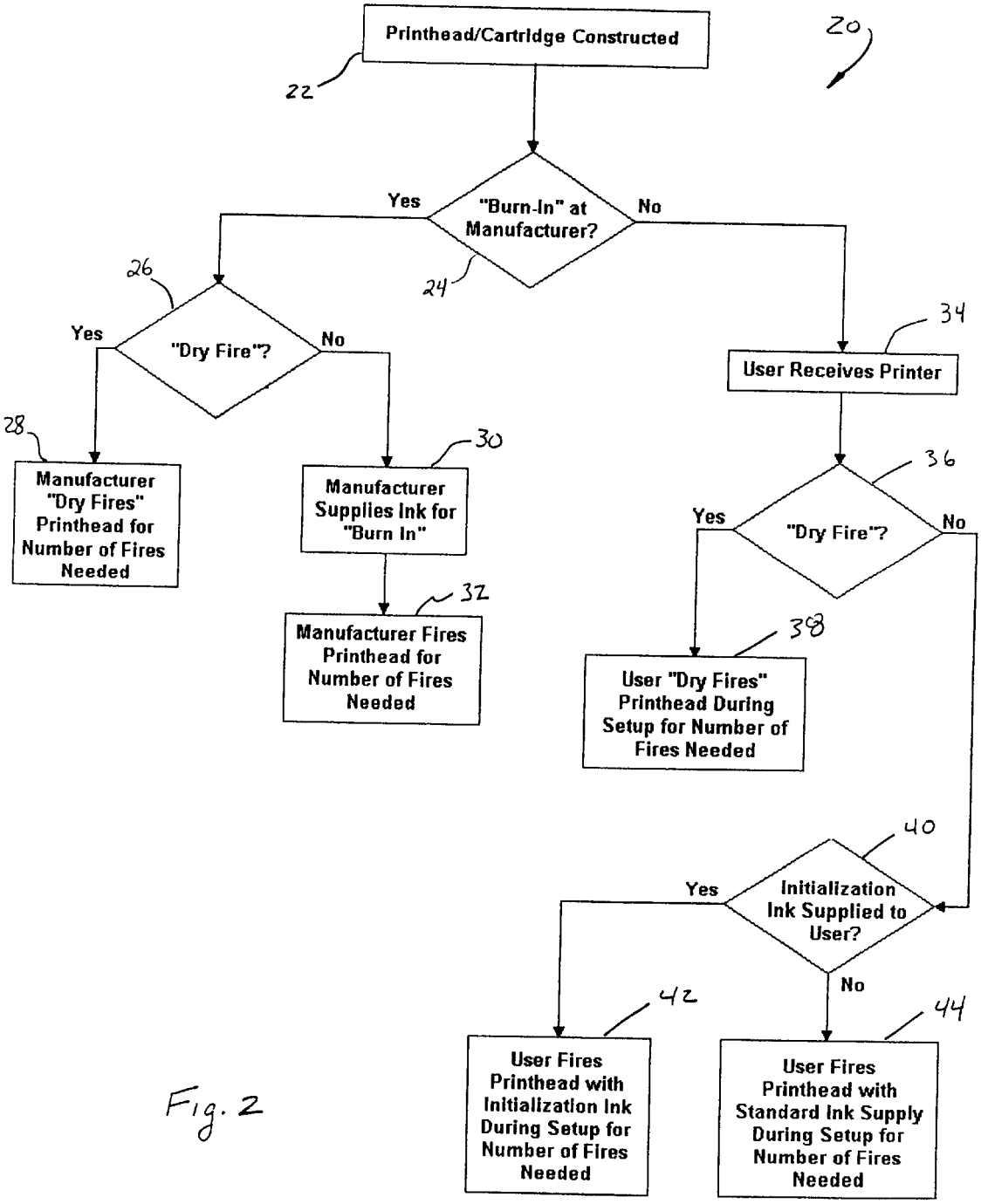
FIG. 2 is a flowchart of steps relating to a burn in operation of the printhead.

One technique for addressing this potential problem is described with reference to the flow chart 20 of FIG. 2. At step 22 the printhead is constructed per known techniques. A subsequent burn-in operation of the printhead can be performed during manufacture, or a printer mechanism can be configured to perform the burn-in operation during an initialization sequence which occurs upon printer start-up after the printer mechanism has been delivered to a consumer. If the burn-in operation is to be performed at manufacture the YES path from step 24 is followed. If the burn-in operation is to be performed as a dry firing operation, meaning that no ink will be provided to or ejected from the printhead during the operation, the YES path from step 26 is followed and at step 28 the manufacturer dry fires the heater resistors of the printhead for the number of fires needed. In this regard, based upon a known resistance degradation curve such as that illustrated in FIG. 1, the manufacturer can identify the substantially stable resistance value to be achieved and can also identify the number of times the heater resistors need to be fired in order to reach that substantially stable resistance value. As used herein the terminology "substantially stable resistance value" is intended to broadly encompass any degraded heater resistor resistance value which is within about three percent (3%) of the resistance level corresponding to the horizontal portion of the resistance degradation curve. If it is desired to perform the burn-in operation while ejecting ink from the printhead, the manufacturer provides a supply of ink for burn in as indicated at step 30 and then proceeds with the firing of the printhead heater resistors at step 32.

As an alternative to burn in at manufacture, a given printer mechanism may be configured with appropriate software and/or firmware to conduct the burn-in operation after the consumer receives the printer mechanism as indicated at step 34. Again, the burn-in operation may be a dry firing or a non-ink ejecting operation as indicated in step 38 following the YES path from step 36. An ink ejecting burn-in operation follows the NO path from step 36 and may involve the use of an initialization ink supply provided to the consumer as indicated in step 42 following the YES path from step 40. Alternatively, the standard ink supply which is provided with the printer may be utilized during the burn-in operation as indicated in step 44 following the NO path from step 40.

Regardless of the particular burn-in operation sequence performed, the end result is the attainment of a substantially stable resistance value in the heater resistors of the printhead, eliminating or reducing the electromigration problem which can be caused by reductions in the resistance of the heater resistors during printer operations. Of course, during the burn-in operation the voltage applied to the heater resistors should be set at a level which does not cause electromigration to occur. This voltage may be preset to that required for the expected substantially stable resistance value which will be reached after burn-in and the same preset voltage may be used for firing the heater resistors in subsequent printing operations. Alternatively, after the burn-in operation, in subsequent printing operations the drive voltage across the heater resistors can be set and adjusted based upon the known substantially stable resistance value in order to assure that the current density through the heater resistors is limited to a level which is less than a current density which causes undesired electromigration.

Figure 3:
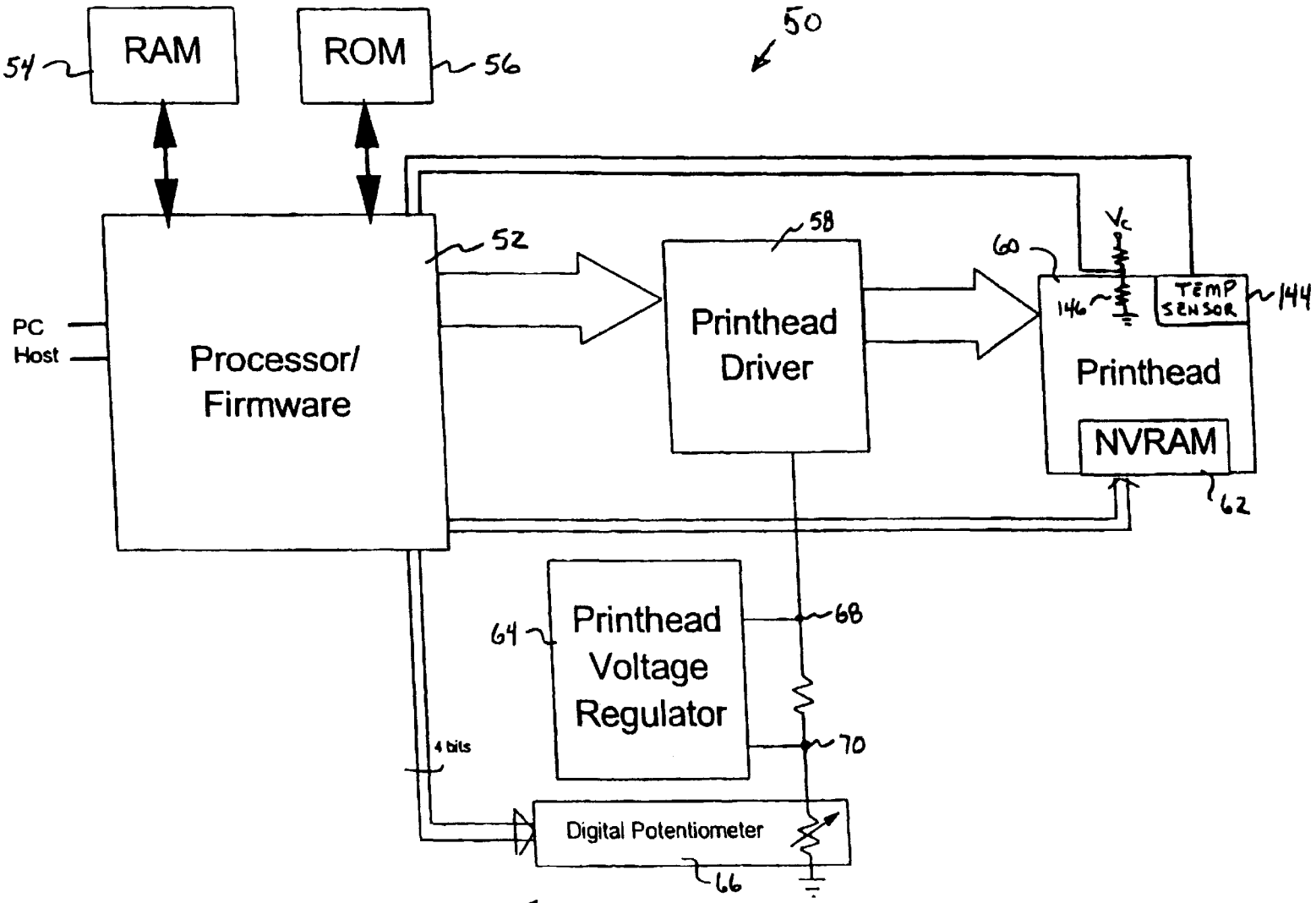
FIG. 3 is a schematic diagram of one embodiment of a printer mechanism.

Referring now to FIG. 3, one alternative method to the aforementioned resistor burn-in technique is described. A schematic block diagram of printer mechanism 50 is illustrated and includes a controller 52 with associated memory 54 and 56. The controller 52 is connected to effect the operation of a printhead driver 58 which controls the ejection of ink from the printhead 60 via selective energization of the heater resistors of the printhead 60. The printhead 60 includes non-volatile RAM 62, with the printhead 60 being configured to maintain within such non-volatile RAM a record of the number of dots fired by the printhead 60. The controller 52 is connected to the printhead 60 for retrieving information from the non-volatile RAM 62. A printhead voltage regulator 64 and digital potentiometer 66 are provided for establishing the drive voltage delivered to the printhead heater resistors. In particular, the regulator 64 establishes the drive voltage at line 68 and a feedback voltage is applied to the regulator at line 70. The controller 52 digitally adjusts the resistance of the potentiometer 66 which causes the feedback voltage at line 70 to vary. The regulator is configured to vary the drive voltage at line 68 based upon changes in the feedback voltage at line 70. In order to account for changes in the resistance of the heater resisters of the printhead 60, the controller 52 is operable to track the changing resistance and adjust the digital potentiometer 66 in order to vary the drive voltage delivered to the heater resistors.

Figure 4:
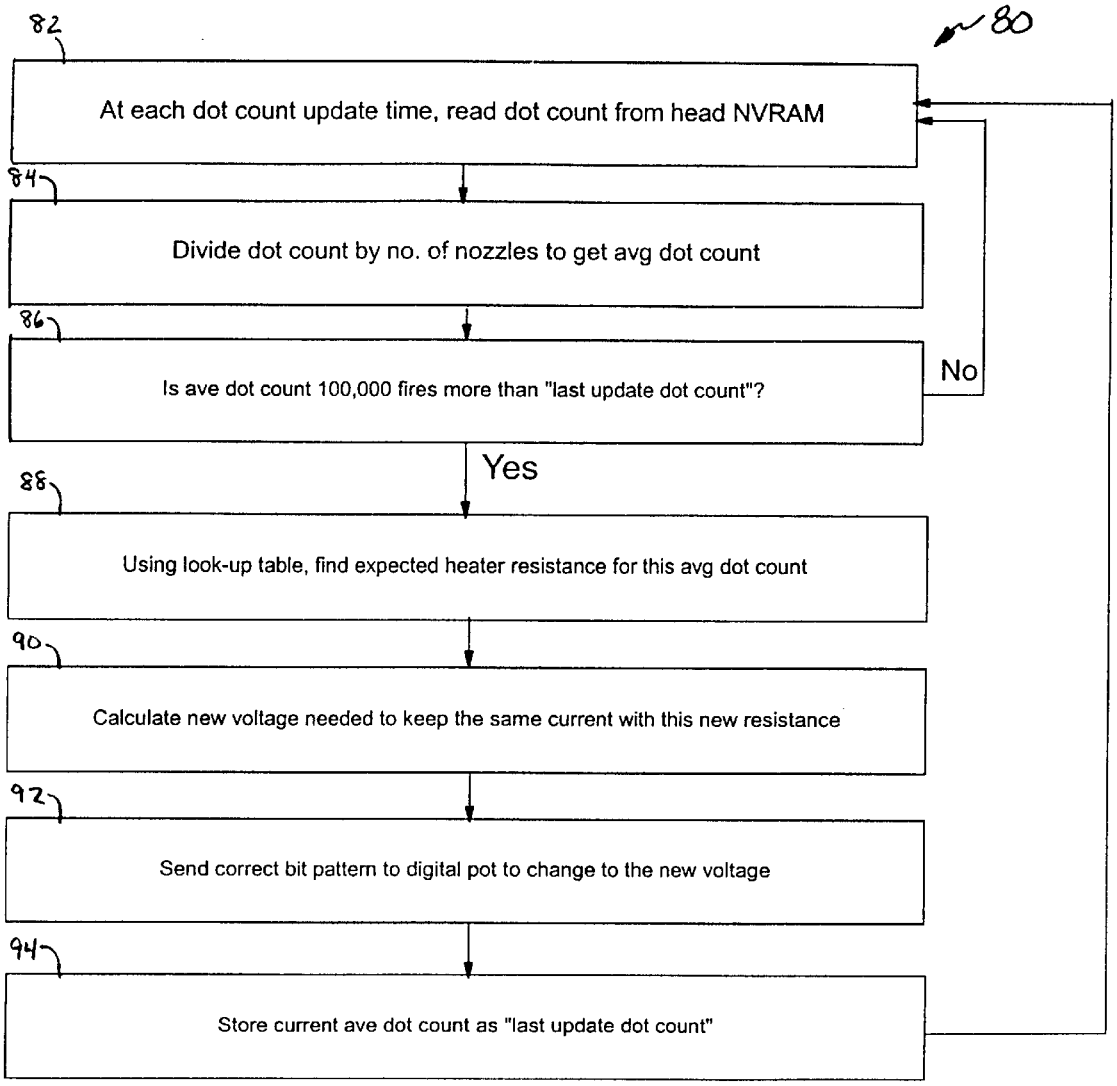
FIG. 4 is a flowchart of printer operating steps in accordance with one embodiment of the present invention.

Referring to FIG. 4, an exemplary flowchart 80 of printer operation is depicted. At step 82 each time the dot count in the printhead non-volatile RAM 62 is updated, the controller 52 reads the dot count from the non-volatile RAM 62. Because the dot count maintained in the non-volatile RAM 62 is typically a total dot count for the printhead 60 and the printhead normally includes a plurality of heater resistors, in step 84 the retrieved dot count number is divided by the number of nozzles or heater resistors in the printhead 60 in order to obtain an average dot count which is representative of the total number of times each heater resistor of the printhead has been fired. Given that the resistance degradation curve or drop off characteristic as represented in FIG. 1 is known and stored in memory associated with the controller 52, the controller is then able to track the changing resistance value of the printhead heater resistors based upon the number of times the heater resistors are fired. In the illustrated embodiment, at step 86, if the average dot count determined in step 84 is greater than a previously stored variable "last update dot count" by an established threshhold value (such as 100,000), the controller 52 proceeds to step 88 and references a stored lookup table of the drop off characteristic to determine the heater resistance which corresponds to the average dot count. At step 90 a new drive voltage needed to maintain a desired current density given the change in resistance is calculated and at step 92 the controller 52 sends a digital signal to the potentiometer 66 to adjust the output of the voltage regulator to the voltage level determined in step 90. Finally, at step 94 the then current average dot count is stored as "last update dot count" for use in a subsequent operation involving step 86. Referring again to step 86, if a given average dot count is not greater than "last update dot count" by the established threshhold level, then steps 88 through 94 are not performed.

The sequence of steps in flowchart 80 provides tracking of the heater resistance value and subsequent adjustment of the firing voltage across the heater resistors as necessary to maintain a desired current density through the heater resistors. Alternatively, the drive voltage established at step 90 could be determined so as to maintain a current density through the heater resistors at or below an established maximum acceptable level. The threshold comparison of step 86 may be performed in order to simplify the amount of look up table data which needs to be stored to represent the resistance characteristic and it is recognized that the threshold change in the average dot count could be selected as desired. Further, it is also recognized that step 86 could be eliminated in its entirety by, for example, utilizing a calculation to determine the heater resistor resistance from the average dot count.

It should also be noted that a simplified, low cost but less accurate version of this approach would remove the voltage adjustment steps and apparatuses. The voltage would be preset to that required to drive the heater resistors once they have reached the substantially stable resistance value and the head would simply be fired a number of times known to comfortably place the resistance of the heater resistors at the substantially stable resistance value.

Figure 5:
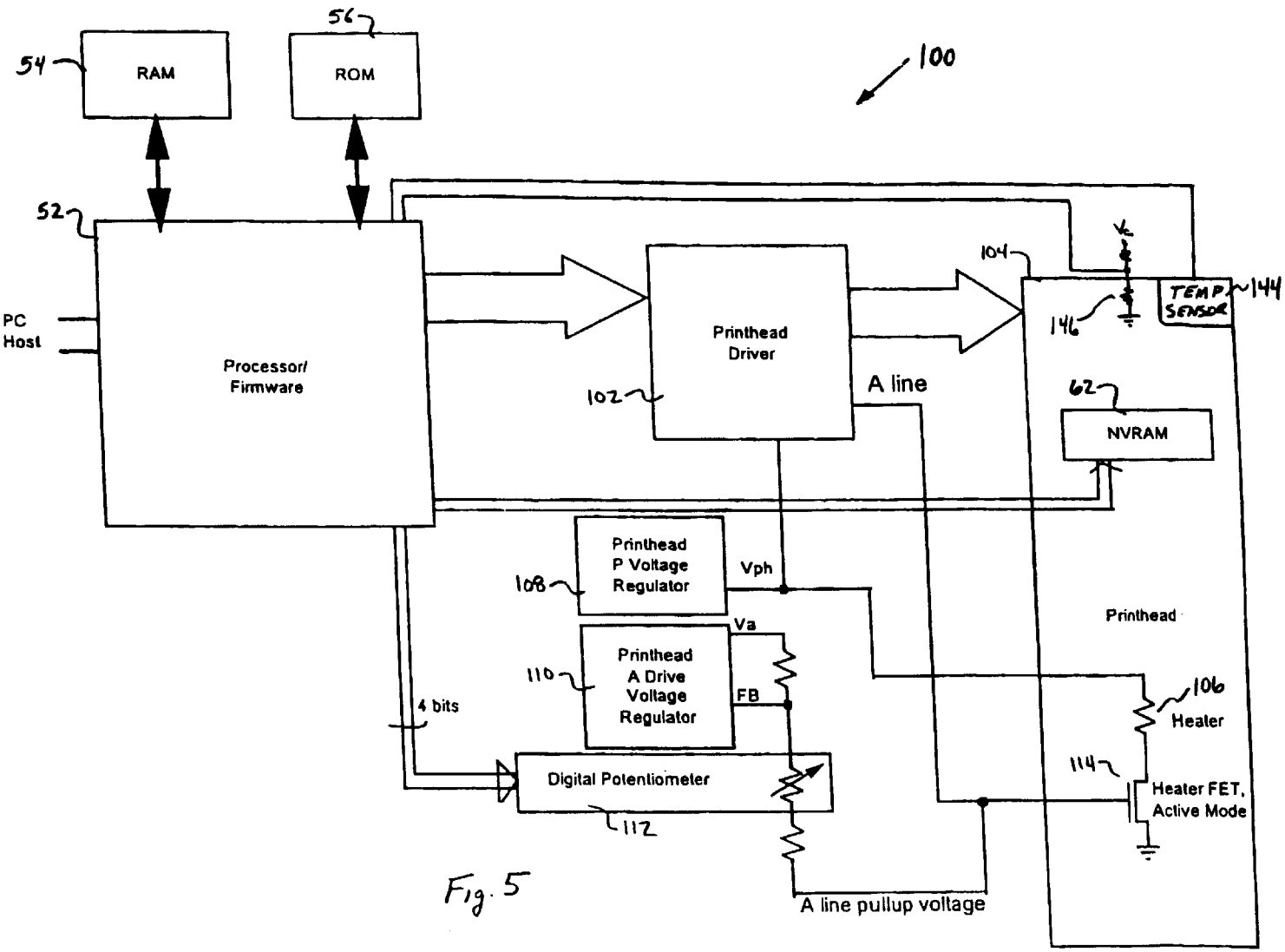
FIG. 5 is a schematic diagram of another printer mechanism.

An alternative configuration of a printer mechanism 100 is depicted in schematic form in FIG. 5. Printer mechanism 100 includes a controller 52 and associated memory 54 and 56 as previously described. The controller 52 is connected for controlling the operation of a printhead driver 102 which in turn controls firing of the heater resistors within printhead 104. The printhead 104 includes non-volatile RAM 62 to which the controller 52 is connected for accessing information stored therein. In printer mechanism 100 the firing voltage across the heater resistor 106 is varied in a slightly different manner than in the printer mechanism 50. In particular, printhead voltage regulator 108 is provided to set a constant drive voltage Vph to the heater resistors 106. A voltage regulator 110 and digital potentiometer 112 combination is provided for adjusting the voltage drop across or current through the transistors 114 which are used to fire the heater resistors 106. Any such change in the voltage drop across or current through the firing transistors 114 causes a corresponding change in the firing voltage across the heater resistors 106 and thus enables the firing voltage to be adjusted as desired.

Figure 6:
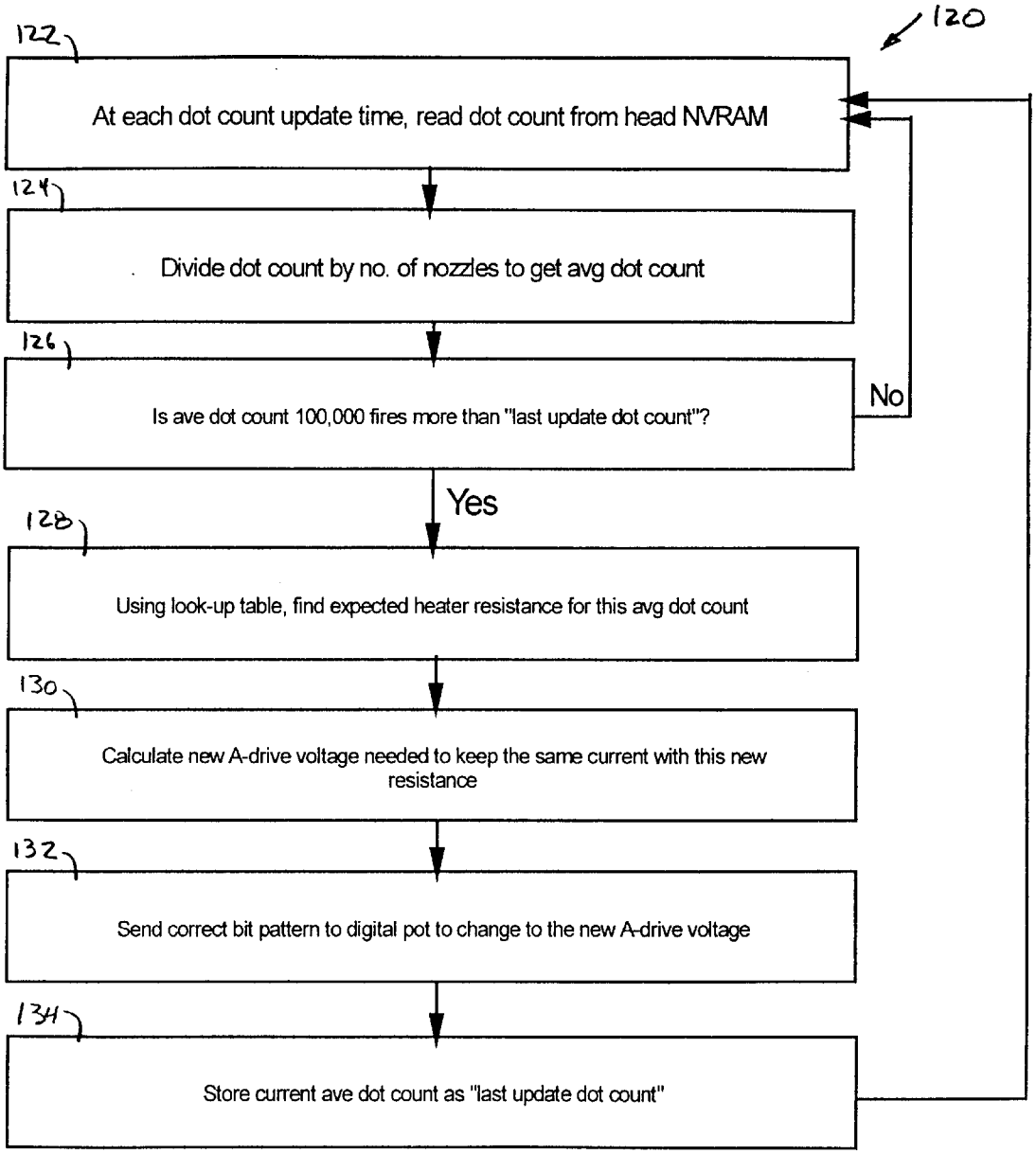
FIG. 6 is a flowchart of printer operating steps in accordance with a second embodiment of the present invention.

In one technique the printer mechanism 100 is controlled in a manner similar to that described previously with respect to printer mechanism 50 in order to control the current density through the heater resistors 106. In particular, referring to the flowchart 120 of FIG. 6, at step 122 the dot count stored in the non-volatile RAM 62 of the printhead 104 is read by the controller 52 when the dot count is updated. The dot count read by the controller is then divided by the number of nozzles or heater resistors in the printhead 104 to obtain an average dot count at step 124. At step 126 if the average dot count exceeds a stored variable "last update dot count" by an established threshold, the controller moves to step 128 and references a resistance degradation lookup table to obtain the heater resistance for the average dot count. At step 130 a new desired output voltage for voltage regulator 110 is determined so as to adjust the firing voltage across the heater resistors as necessary to maintain a desired current density through the heater resistors 106 or as necessary to assure that the current density through the heater resistors 106 does not exceed an established maximum acceptable level. The controller 52 then sends a digital signal to potentiometer 112 which causes adjustment of the variable resistance as necessary to achieve the newly determined output voltage from the voltage regulator 110, as indicated in step 132. At step 134 the current average dot count is stored as "last update dot count" for use in step 126 of a subsequent operation. Thus, printer mechanism 100 provides a slightly different configuration for varying the firing voltage across the heater resistors.

Figure 7:
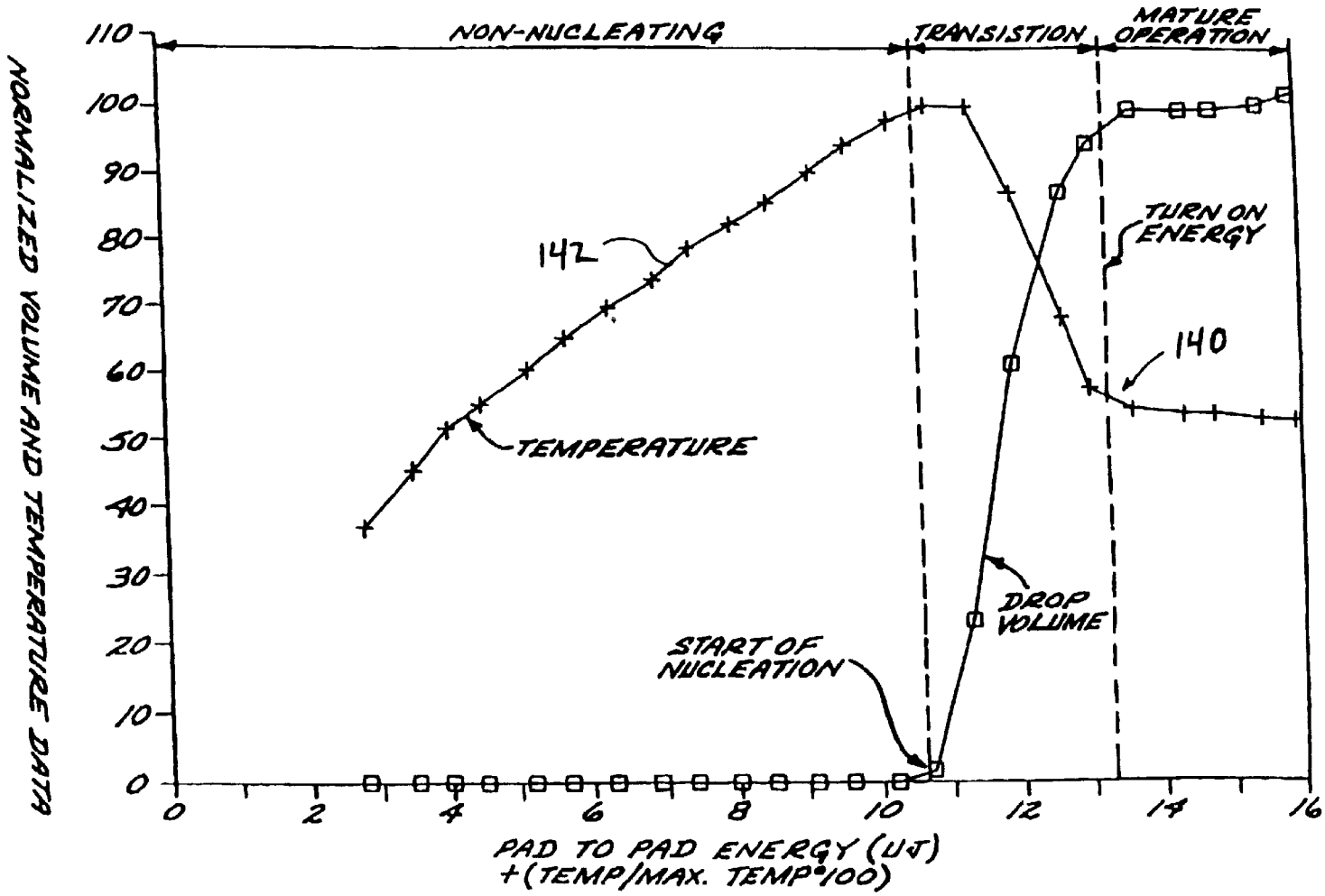
Fig. 7 (PRIOR ART)
FIG. 7 is a graph illustrating a thermal turn on energy test.

While the use of a known resistance degradation curve in combination with tracking of heater resistor firings has been described for the purpose of tracking or monitoring changes in the resistance of heater resistors, it is recognized that other techniques might also be used. For example, referring to FIG. 7, the use of a thermal turn on energy test to track changes in heater resistor resistance might also be used. FIG. 7 corresponds to FIG. 2 as set forth in U.S. Pat. No. 5,428,376. As described in such patent, a thermal turn on energy test involves the application of repeated warming voltage pulses to the printhead to warm the printhead to a temperature that is as least as high as the temperature that would be produced pursuant to ink firing pulses of a predetermined voltage, a predetermined pulse width and a predetermined pulse frequency. A continuous series of ink firing pulses are then applied to the printhead, starting with the pulse energy substantially equal to the predetermined reference pulse energy at a pulse frequency equal to the predetermined pulse frequency, and then incrementally decreasing the pulse energy of the ink firing pulses. The temperature of the printhead is repeatedly sampled while the ink firing pulses are applied to the heater resistors to produce a set of temperature samples respectively associated with the decreasing pulse energies. A thermal turn on energy is then determined from the temperature samples, and the printhead can then be operated at a pulse energy that is greater than but near to the thermal turn on energy. As shown in FIG. 7, the knee 140 in temperature curve 142 identifies the turn on energy of the printhead, that is, the energy at which the printhead would begin ejecting ink droplets from its nozzles.

Figure 8:
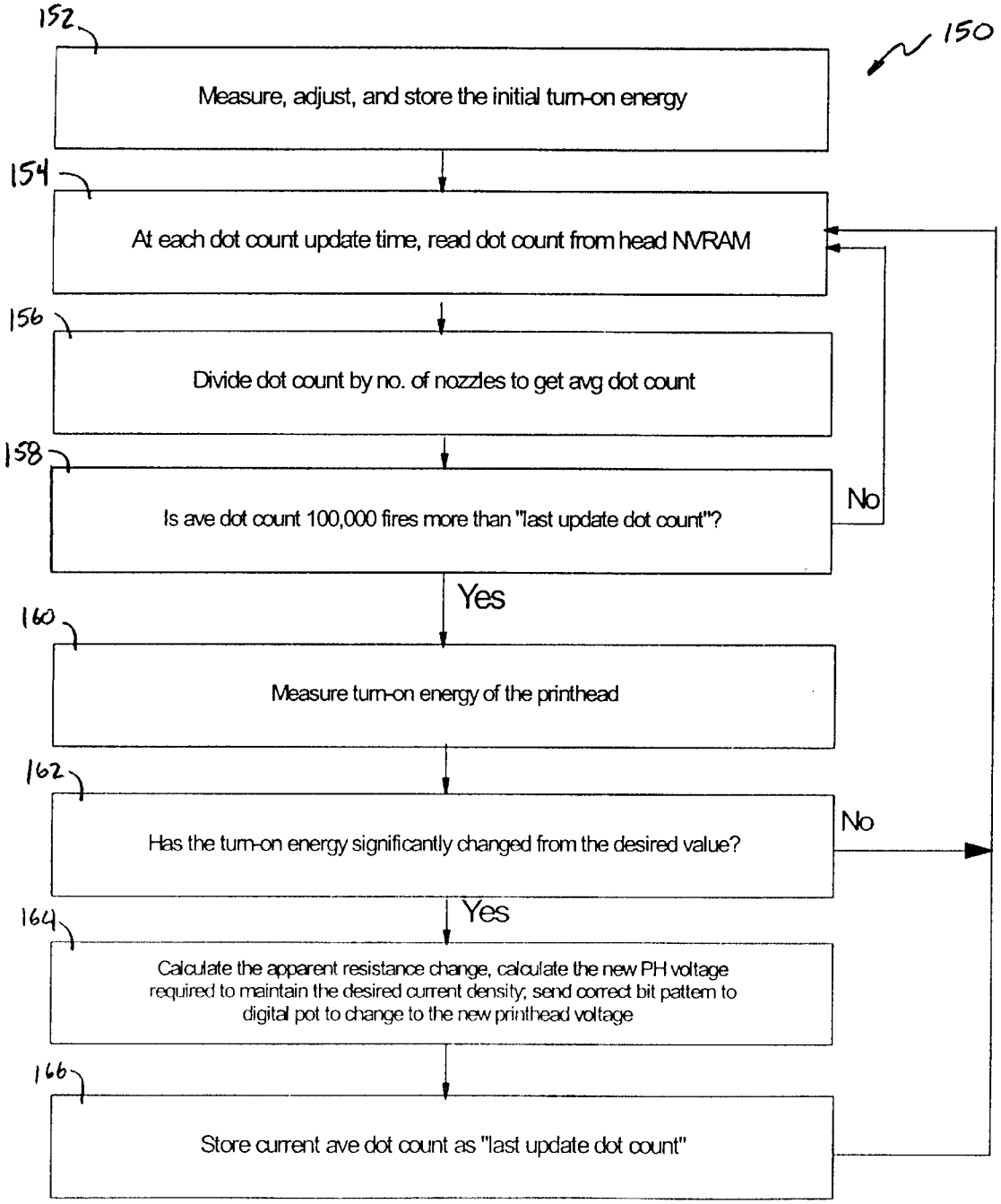
FIG. 8 is a flowchart of printer operating steps in accordance with a third embodiment of the present invention.

For purposes of the present invention, the printer mechanism controller 52 may be configured to receive signals from a printhead temperature sensor 144 in order to find the knee 140 in curve 142. As shown with reference to FIG. 5, the printhead 104 includes a sample resistor 146 having a precisely defined resistance ratio relative to each of the heater resistors 106. By monitoring the voltage drop across the sample resistor 146 the controller can determine the pad to pad resistance associated with the heater resistors in order to determine the energy provided to the heater resistors as described in detail in U.S. Pat. No. 5,428,376. The thermal turn on energy test can be used to track the changing resistance of the heater resistors as now described with reference to flowchart 150 of FIG. 8. At step 152 an initial turn on energy of the printhead is measured by the thermal turn on energy test. At step 154 the dot count is read from the non-volatile RAM 62 of the printhead 104. The dot count read at step 154 is divided by the number of nozzles or heater resistors at step 156 to obtain an average dot count. At step 158 the average dot count is compared to a stored variable "last update dot count" and if the average dot count exceeds the stored variable by a threshold level the controller 52 moves to step 160 where the turn on energy of the printhead is again measured. At step 162 if there has been no significant change in the turn on energy it is assumed that the resistance of the heater resistors has not changed as indicated by the NO path which returns to step 154. If, however, the turn on energy has changed significantly, the controller moves to step 164 and calculates an apparent resistance change based upon the change in the turn on energy. In particular, assuming all other conditions remain constant, any change in the thermal turn on energy can be correlated to a change in the heater resistor resistance. At step 164 the controller also calculates a new firing voltage across heater resistor 106 and sends a signal to potentiometer 112 in order to achieve such firing voltage. At step 166 the current average dot count is stored as the variable "last update dot count" for use in subsequent operations at step 158. Although the flowchart 150 has been described with reference to FIG. 5, it is recognized that the printer mechanism 50 of FIG. 3 could likewise incorporate the temperature sensor 144 and sample resistor 146 for purposes of monitoring changes in the resistance of the heater resistors of printhead 60 as shown.

Each of the above-described techniques enables electromigration within the printhead heater resistors to be reduced or prevented in order to extend the life of such printheads. Although the invention has been described above in detail referencing the preferred embodiments thereof, it is recognized that various changes and modifications could be made without departing from the spirit and scope of the invention. For example, other known or hereafter discovered techniques for determining, tracking and monitoring changes in the resistance of printhead heater resistors could be utilized in conjunction with the present invention. Likewise, other known or hereafter discovered techniques for adjusting the firing voltage across printhead heater resistors could be utilized in conjunction with the present invention.

What is claimed is:

1. A method for limiting electromigration within heater resistors of a printhead of an ink jet printer, the method comprising the steps of:

determining a resistance drop off characteristic of the printhead heater resistors;

identifying a substantially stable resistance value of the printhead heater resistors based upon the resistance drop off characteristic;

running the printhead through a resistor burn in operation which involves repeatedly firing a multiplicity of the heater resistors until a resistance value of each heater resistor of said multiplicity drops to the substantially stable resistance value; and adjusting a voltage drop across the heater resistors in subsequent printing operations based upon the identified substantially stable resistance value in order to limit current density through the heater resistors to a level which is less than a current density level which causes undesired electromigration.

2. The method of claim 1 wherein the voltage drop adjusting step involves one of the following techniques:

(i) varying a drive voltage applied to the heater resistors;

(ii) varying a current through or a voltage drop across transistors connected in series with the heater resistors.

3. The method of claim 1 wherein the step of running the printhead through a burn in operation is performed during manufacture of the ink jet printer.

4. The method of claim 1 wherein the step of running the printhead through a burn in operation is performed without ejecting ink from the printhead.

5. A method for limiting electromigration within heater resistors of a printhead of an ink jet printer, the method comprising the steps of:

determining a resistance drop off characteristic of the printhead heater resistors;

identifying a substantially stable resistance value of the printhead heater resistors based upon the resistance drop off characteristic;

running the printhead through a resistor burn in operation which involves repeatedly firing a multiplicity of the heater resistors until a resistance value of each heater resistor of said multiplicity drops to the substantially stable resistance value;

applying a preset constant drive voltage to the heater resistors during the burn in operation, wherein the preset constant drive voltage is established based upon the identified substantially stable resistance value; and applying the same preset constant drive voltage to the heater resistors in subsequent printing operations.

6. A method for limiting electromigration within heater resistors of a printhead of an ink jet printer, the method comprising the steps of:

determining a resistance drop off characteristic of the printhead heater resistors;

identifying a substantially stable resistance value of the printhead heater resistors based upon the resistance drop off characteristic;

running the printhead through a resistor burn in operation which involves repeatedly firing a multiplicity of the heater resistors until a resistance value of each heater resistor of said multiplicity drops to the substantially stable resistance value, wherein the step of running the printhead through a burn in operation is performed during an initialization sequence of the ink jet printer.

7. A method for limiting electromigration within heater resistors of a printhead of an ink jet printer, the method comprising the steps of:

determining a resistance drop off characteristic of the printhead heater resistors;

identifying a substantially stable resistance value of the printhead heater resistors based upon the resistance drop off characteristic;

running the printhead through a resistor burn in operation which involves repeatedly firing a multiplicity of the heater resistors until a resistance value of each heater resistor of said multiplicity drops to the substantially stable resistance value, wherein the step of running the printhead through a burn in operation is performed while ink is delivered to the printhead such that ink is ejected from the printhead during the burn in operation.

8. A method of controlling firing of a heater resistor within a printhead of an ink jet printer, the method comprising the steps of:

establishing a desired current density for the heater resistor;

monitoring a resistance of the heater resistor; and based at least in part upon the monitored resistance, adjusting a firing voltage across the heater resistor in order to maintain the desired current density through the heater resistor.

9. The method of claim 8 wherein the monitoring step involves:

tracking a number of times the heater resistor has been fired; and determining a resistance value of the heater resistor based upon the tracked number.

10. The method of claim 9 wherein the tracking step involves maintaining a running count of the total number of dots fired by the printhead and dividing the total number of dots by a number of heater resistors on the printhead.

11. The method of claim 9 wherein the resistance value is inferred from a known resistance degradation curve of the resistor which is stored as a map in memory.

12. The method of claim 8 wherein said monitoring step involves:

identifying an initial resistance of the heater resistor;

repeatedly determining a thermal turn on energy of the printhead; and correlating changes in determined thermal turn on energy to changes in resistance of the heater resistor.

13. The method of claim 8 wherein the adjusting step involves:

adjusting a potentiometer resistance in order to vary a printhead drive voltage output by a voltage regulatory.

14. The method of claim 8 wherein the adjusting step involves:

adjusting a current through or a voltage drop across a transistor connected in series with the heater resistor.

15. A method of controlling firing of a heater resistor within a printhead of an ink jet printer, the method comprising the steps of:

establishing a maximum acceptable current density for the heater resistor;

monitoring a resistance of the heater resistor; and based at least in part upon the monitored resistance, adjusting a firing voltage across the heater resistor in order to hold current density through the heater resistor at or below the maximum acceptable current density.

16. The method of claim 15 wherein the monitoring step involves:

tracking a number of times the heater resistor is fired during the time period of operation; and determining a resistance value of the heater resistor based upon the tracked number.

17. The method of claim 16 wherein the tracking step involves maintaining a running count of the total number of dots fired by the printhead and dividing the total number of dots by a number of heater resistors on the printhead.

18. The method of claim 15 wherein said monitoring step involves:

identifying an initial resistance of the heater resistor;

repeatedly determining a thermal turn on energy of the printhead; and correlating changes in determined thermal turn on energy to changes in resistance of the heater resistor.

19. The method of claim 15 wherein the adjusting step involves:

adjusting a potentiometer resistance in order to vary a printhead drive voltage output by a voltage regulator.

20. The method of claim 15 wherein the adjusting step involves:

adjusting a current through or a voltage drop across a transistor connected in series with the heater resistor.

21. A printer mechanism, comprising:

a printhead including a plurality of heater resistors;

a printhead driver circuit operatively connected to the printhead for selectively energizing the heater resistors;

a controller connected with said printhead driver circuit for effecting operation thereof, wherein the controller is operable to determine a resistance of the printhead heater resistors, and the controller is further operable to adjust a firing voltage across the heater resistors based at least in part upon the determined resistance value, wherein the controller is operable to adjust the firing voltage across the heater resistors in order to maintain current density through the resistors at or below an established threshold maximum level.

22. The printer mechanism of claim 21 wherein the controller is connected to a potentiometer, and is operable to vary a resistance of the potentiometer in order to adjust the firing voltage across the heater resistors.

23. The printer mechanism of claim 21 wherein the controller is connected to a transistor connected in series with a heater resistor, and is operable to vary a current through or a voltage drop across the transistor in order to adjust the firing voltage across the heater resistor.

24. A printer mechanism, comprising:

a printhead including a plurality of heater resistors;

a printhead driver circuit operatively connected to the printhead for selectively energizing the heater resistors;

a controller connected with said printhead driver circuit for effecting operation thereof, wherein the controller is operable to determine a resistance of the printhead heater resistors, and the controller is further operable to adjust a firing voltage across the heater resistors based at least in part upon the determined resistance value, wherein the controller is operable to determine resistance of the printhead heater resistors by tracking a number of times the heater resistors are fired and determining a resistance value of the heater resistors based upon the tracked number, wherein a dot count is maintained in memory associated with the printhead, and the controller is connected to receive information from the printhead memory.

25. The printer mechanism of claim 24 wherein the controller is operable to adjust the firing voltage across the heater resistors in order to maintain a desired current density through the heater resistors.

26. A printer mechanism, comprising:

a printhead including a plurality of heater resistors;

a printhead driver circuit operatively connected to the printhead for selectively energizing the heater resistors;

a controller connected with said printhead driver circuit for effecting operation thereof, wherein the controller is operable to determine a resistance of the printhead heater resistors, and the controller is further operable to adjust a firing voltage across the heater resistors based at least in part upon the determined resistance value, wherein the controller is operable to determine resistance of the printhead heater resistors by repeatedly determining a thermal turn on energy of the printhead and correlating changes in determined thermal turn on energy to changes in resistance of the heater resistor.

27. The printer mechanism of claim 26 wherein the controller is operable to adjust the firing voltage across the heater resistors in order to maintain current density through the resistors at or below an established threshold maximum level.

28. The printer mechanism of claim 26 wherein the controller is operable to determine a thermal turn on energy of the printhead on a periodic basis.

29. The printer mechanism of claim 26 wherein the controller is operable to track the number of times the heater resistors are fired and to initiate a thermal turn on energy determination sequence each time the printhead heater resistors are fired a certain number of times.

* * * * *